US005738611A

United States Patent [19]

Ehrenfried et al.

[11] Patent Number: 5,738,611

[45] Date of Patent: Apr. 14, 1998

[54] AEROBIC AND STRENGTH EXERCISE APPARATUS

[75] Inventors: Ted R. Ehrenfried; Scott Alan Ehrenfried, both of Suffolk, Va.

[73] Assignee: The Ehrenfried Company, Suffolk, Va.

[21] Appl. No.: 352,170

[22] Filed: Dec. 1, 1994

Related U.S. Application Data

[63] Continuation-in-part of Ser. No. 70,744, Jun. 2, 1993, abandoned.

[51] Int. Cl.[6] ..... A63B 21/005

[52] U.S. Cl. ..... 482/6; 482/7; 482/129; 482/9

[58] Field of Search ..... 482/1, 4–7, 9, 482/51, 52, 54, 903, 129, 130

[56] References Cited

U.S. PATENT DOCUMENTS

| | | | |
|---|---|---|---|
| Re. 34,959 | 5/1995 | Potts . | |
| 319,686 | 6/1885 | Farmer . | |
| 3,465,592 | 9/1969 | Perrine . | |
| 3,588,101 | 6/1971 | Jungreis . | |
| 3,640,530 | 2/1972 | Henson et al. . | |
| 3,848,467 | 11/1974 | Flavell . | |
| 4,082,267 | 4/1978 | Flavell | 482/6 |
| 4,138,106 | 2/1979 | Bradley . | |
| 4,184,678 | 1/1980 | Flavell et al. | 482/6 |
| 4,231,568 | 11/1980 | Riley et al. . | |
| 4,261,562 | 4/1981 | Flavell . | |
| 4,540,171 | 9/1985 | Clark et al. . | |
| 4,609,189 | 9/1986 | Brasher . | |
| 4,678,184 | 7/1987 | Neiger et al. . | |
| 4,751,917 | 6/1988 | Ruf . | |
| 4,765,613 | 8/1988 | Voris . | |
| 4,770,411 | 9/1988 | Armstrong et al. . | |
| 4,811,946 | 3/1989 | Pelczar . | |
| 4,822,036 | 4/1989 | Dang . | |
| 4,822,946 | 4/1989 | Dang . | |
| 4,842,274 | 6/1989 | Oosthuizen et al. . | |
| 4,848,737 | 7/1989 | Ehrenfield . | |
| 4,869,497 | 9/1989 | Stewart et al. . | |
| 4,930,770 | 6/1990 | Baker . | |
| 4,979,733 | 12/1990 | Prud' Hon | 482/4 |
| 5,011,142 | 4/1991 | Eckler . | |
| 5,020,794 | 6/1991 | Englehardt et al. . | |
| 5,037,089 | 8/1991 | Spagnuolo et al. . | |
| 5,039,092 | 8/1991 | Olschansky et al. . | |
| 5,060,938 | 10/1991 | Hawley, Jr. . | |
| 5,117,170 | 5/1992 | Keane et al. . | |
| 5,147,263 | 9/1992 | Mueller | 482/112 |
| 5,180,351 | 1/1993 | Ehrenfried | 482/52 |
| 5,263,909 | 11/1993 | Ehrenfried | 482/52 |
| 5,308,303 | 5/1994 | Rawls et al. . | |
| 5,354,248 | 10/1994 | Rawls et al. | 482/6 |
| 5,380,258 | 1/1995 | Hawley, Jr. . | |
| 5,387,170 | 2/1995 | Rawls et al. . | |

FOREIGN PATENT DOCUMENTS

| | | |
|---|---|---|
| 0276125 | 7/1988 | European Pat. Off. . |

*Primary Examiner*—Richard J. Apley
*Assistant Examiner*—John Mulcahy
*Attorney, Agent, or Firm*—Kenyon & Kenyon

[57] ABSTRACT

An exercise apparatus having a pair of speed control drums coaxial with a variable speed motor driven shaft is disclosed. A force control drum is mounted to a gear box via which the motor is linked to the shaft. A cable is wound about the force control drum, with one of the free ends of the cable being connected to a force spring. A user-controlled cable is wound about the speed control drums so that by pulling on the cable, the speed control drums rotate with respect to the shaft. Movement of the user controlled cable above a pre-set speed causes the force control drum to wind cable in a manner that extends the force spring. The apparatus permits the user to control both the magnitude of machine resistance encountered and the speed with which loads are obtained.

53 Claims, 7 Drawing Sheets

AEROBIC AND STRENGTH EXERCISE APPARATUS

RELATED APPLICATION

This application is a Continuation-In-Part of U.S. application Ser. No. 08/070,744 which was filed on Jun. 2, 1993, and is now abandoned.

BACKGROUND OF THE INVENTION

The present invention relates generally to muscle exercise apparatus and, more specifically, to exercise apparatus capable of providing both cardiovascular and strength training.

Researchers believe that human muscle is made up of fast contracting fibers and slow contracting fibers. The fast contracting fibers are recruited only infrequently—generally for rapid power movements or high intensity isometric contractions. The slow contracting fibers, on the other hand, are recruited for repetitive low-intensity activity, such as long distance running or cycling. The neuro-muscular organization characteristic of the most rapid or "ballistic" types of muscle activities is believed to differ from that which characterizes slow muscle activity.

In particular, researchers believe that human voluntary muscle strength is determined not only by the quantity (i.e., muscle cross-sectional area) and quality (muscle fiber type) of the muscle mass involved, but also by neural factors governing the extent to which the muscle fibers making up the muscle can be activated. According to one theory, the neural adaptation of muscle to high velocity training is associated with an accentuation of the manner in which fast twitch motor units are preferentially activated. In other words, fast muscles (those with a relatively high proportion of fast twitch motor units) may preferentially be activated over slow muscles in the execution of high velocity movements. This theory further posits that slow muscles (i.e., those with a relatively low proportion of fast-twitch motor units) are preferentially activated in the course of executing slower movements. The proper exploitation of this model of human muscle physiology in a strength training machine requires an apparatus capable of accommodating high velocity movements across a full range of machine supplied resistance levels, from high to low, as well as lower velocity movements across a similarly full range of resistance levels.

Still other variables are relevant in considering cardiovascular response—the other side of the fitness equation. Cardiovascular output is responsive in great measure to the demands placed on the musculature of the human body. While such physiological parameters as heart rate, blood pressure and cardiac output rise in response to increases in the quantity of muscle mass activated, the response is not linear. Still other variations have been observed to occur depending on the type of exercise involved. For example, it has been observed during the course of repetitious exercises involving concentric and eccentric motions that higher blood pressures occur during the eccentric portion of the exercise than in the concentric portion. While cardiac output is significantly lower during the concentric as compared to the eccentric portion of an exercise repetition, the heart's rate of beating is the same during the eccentric and concentric portions; the difference in cardiac output results from the smaller stroke volume during the concentric phase of the exercise. These and other findings strongly suggest that exercise equipment should preferentially be able to accommodate a wide array of workout regimens.

Many different types of fitness equipment have been developed to assist the individual in enhancing his muscle strength, and still other machines have been developed to enhance the individual's cardiovascular fitness. Treadmills, climbers, rowing machines, and stationary bikes are a few examples of apparatus that focus on enhancing cardiovascular fitness. Weight systems, hydraulic and air resistance devices, and electronic resistance devices are but a few of the types of apparatus that focus on the strength side of fitness. The general state of the technology is set forth in U.S. Pat. No. 3,465,592 to Perrine; U.S. Pat. No. 5,011,142 to Eckler; U.S. Pat. No. 4,261,562 to Flavell/and U.S. Pat. No. 5,180,351 to Ehrenfried, the contents of each of which are incorporated herein by reference.

Many of the known types of exercise machines are quite expensive, difficult to use or adjust, and offer the user only limited success in enhancing either cardiovascular fitness or muscle strength. Typical among the deficiencies present in such machines is their tendency to focus on a small range of physical fitness considerations to the exclusion of others, and often while utilizing expensive components. Even where they are of simple construction and lower expense (e.g., a weight stack) they are often cumbersome to use, e.g., when changing loads. Where load changing has been made more automatic; the machines are often prohibitively expensive.

There remains a need for an inexpensive exercise apparatus that addresses both muscle strength and cardiovascular fitness concerns by accommodating a wide array of exercise regimens. There remains a need for an inexpensive machine that can afford the user the option of varying the speed of his workout independently of the level of machine supplied resistance he wishes to work against, and that does so in an ergonomically suitable manner.

SUMMARY OF THE INVENTION

The present invention discloses an exercise apparatus having features that allow for both cardiovascular and strength training without requiring the user to perform any cumbersome modification to the apparatus to alter the resistance mechanism of the apparatus. The exercise apparatus provides a means for accommodating rapid as well as slow muscle movements across a full range of loading conditions that can be used to enhance both cardiovascular fitness and muscle strength.

The apparatus of the primary embodiment includes an electrically driven mechanical drive-train to establish control over a threshold level of velocity (chosen by the user) at which cables that are attached to an exercise interface first engage a variable resistance element. The variable resistance element adjusts the level of resistance provided by the exercise machine to the user in response to the user's physical efforts to match, fall beneath, or exceed the threshold level of velocity preset by the user.

In the primary embodiments, two operating cables are attached to an exercise apparatus which provides the user with a reciprocal, positive resistance, concentric contraction range of motion workout for the arms.

Further features of the invention include the capability of the variable resistance mechanism employed to provide the user with a work-out having the dynamics characteristic of isotonic resistance devices, such as those employing weight stacks. A further feature of the apparatus enables the user to experience any of a broad range of resistance levels without having to interrupt his exercise program to adjust the control mechanism of the apparatus to alter the load. A further feature of the apparatus enables the user to experience a given level of resistance while working out with a velocity level of his choosing. Thus, the user is able to separate the load level he encounters (which is under his immediate control) from the velocity with which he works against that load level. The user has control over the range of motion of his workout, his workout speed, the machine resistance he works against, the total mechanical work he performs, and his power output. The mechanism by which these features are provided is of both sophisticated design and relatively simple construction.

BRIEF DESCRIPTION OF THE DRAWINGS

These and other features of the invention will be more fully appreciated from the following detailed descriptions, taken in conjunction with the accompanying drawings, in which like parts are given like reference numerals and wherein.

DETAILED DESCRIPTION

FIGS. 1–4 illustrate a first embodiment of an exercise apparatus constructed according to the principles of the invention. As sequentially illustrated in FIGS. 1–4, this embodiment may be viewed as comprising four subsystems that will be discussed in turn. They are: first, a velocity control mechanism; second, a variable isotonic-capable resistance system; third, a machine-user interface; and fourth, an electronic control system.

The first subsystem establishes velocity control as a primary variable governing the effects attendant to the user's manipulation of the exercise apparatus. The second subsystem can provide both user-variable levels of isotonic resistance as well as non-isotonic resistance regimes. The third subsystem provides an interface linking the user's efforts to the velocity control and the variable isotonic resistance systems. The fourth subsystem consists of a microprocessor, data collection sensors, electronic displays to provide electronic control of the apparatus, and may vary in its complexity depending on which optional features are sought by the user.

Figure 8:
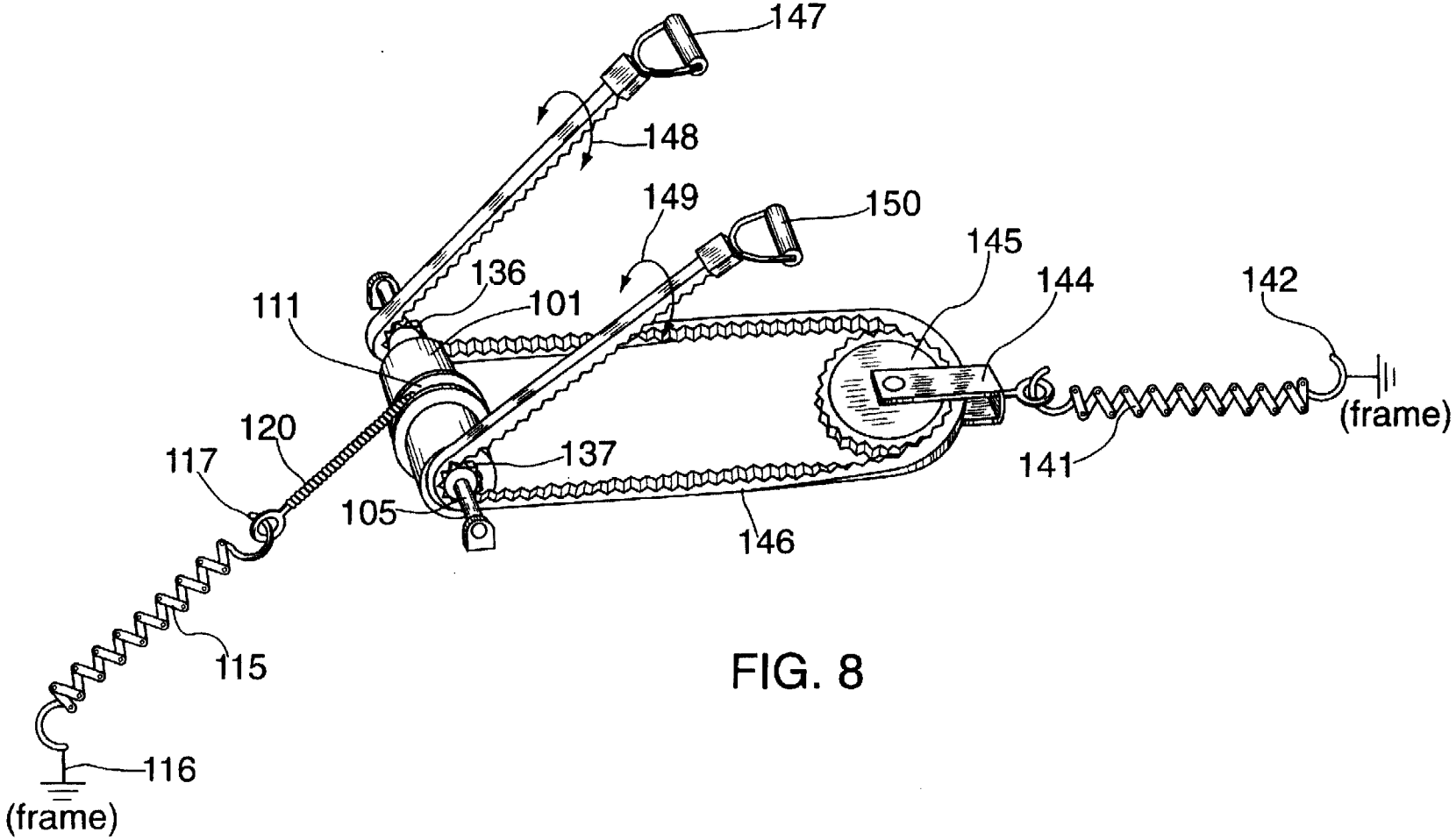
FIG. 8 is a perspective diagrammatic view of an additional embodiment of an exercise apparatus employing certain principles of the invention.

A simplified embodiment employing certain of the principles of the invention is shown in FIG. 8.

1. Velocity Control Mechanism

Figure 1:
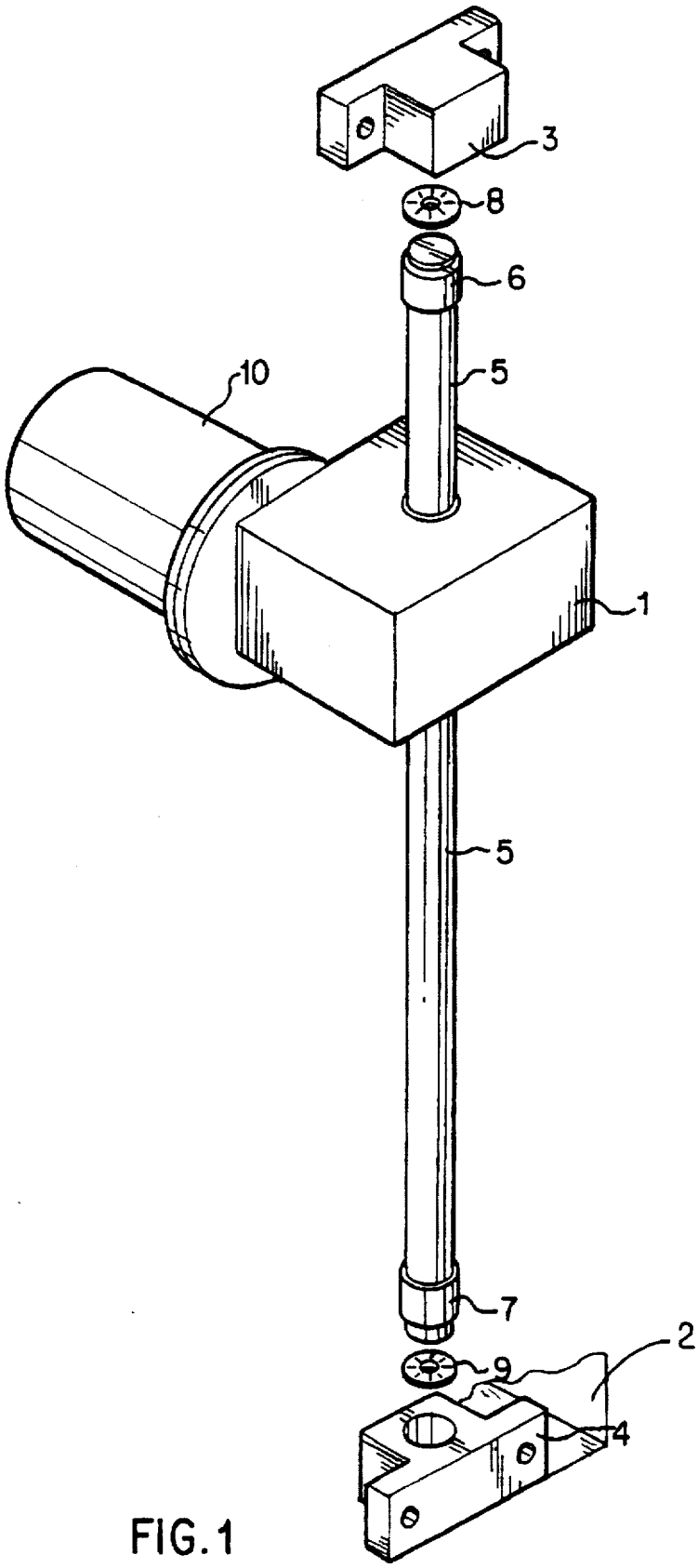
FIG. 1 is a schematic perspective partially exploded view of an electrically driven mechanical drive mechanism for providing velocity control over a shaft.

FIG. 1 shows in schematic perspective form a partially exploded view of the velocity control mechanism. In FIG. 1, a constant speed drive comprising a single-reduction wormgear 1 is mounted onto an apparatus frame 2 via pillow blocks 3 and 4 located on either end of an output shaft 5. Pressed into each of the pillow blocks 3 and 4 is a one way clutch bearing 6 and 7 which permits the output shaft 5 to turn only in a clockwise direction of rotation (as viewed from the upper pillow block) within the pillow blocks. Also disposed within the pillow blocks 3 and 4 are thrust bearings 8 and 9 respectively, which ride against each end surface of the output shaft 5 to lock the output shaft against axial movement.

An output shaft driver is provided in the form of an electric motor 10 whose output shaft is coupled to the wormgear and housing. The input shaft of the wormgear 1 is driven so as to cause the output shaft 5 to turn in the clockwise sense (again, as viewed from the upper pillow block 3) with respect to the motor and wormgear at a user selected speed. A DC motor speed controller (not shown) provides constant motor speed to ensure that the worm output shaft 5 continues to rotate at the selected speed under the various loads imposed during operation of the exercise apparatus. (In this embodiment, the speed controller is seen to provide both minimum output shaft speed and maximum output shaft speed. However, it is within the scope of this invention to provided variants of this device in which only maximum output shaft speed is provided.)

Other devices could be used to provide appropriate shaft speed drive instead of an electrical motor and worm gear. For example, a flywheel and brake, an electrical generator or alternator with resistor bank, an Eddy current brake, a magnetic particle brake, or a centrifugal brake could each be adapted for use in place of the electric motor and wormdrive to provide the same general functional capabilities. As these alternative devices are not as easily fitted to the apparatus as is the electric motor and worm gear combination, they are not favored for use in the preferred embodiment.

2. Variable Resistance System

In the structure described thus far, the wormgear 1 and attached electric drive motor 10 are free to rotate in a clockwise direction whether or not the motor is turning the wormgear input shaft. Similarly, the motor and wormgear also can be rotated in a counterclockwise direction with respect to the pillow blocks while the motor drives the shaft. This counterclockwise rotation is limited to an angular speed that is less than or equal to the clockwise speed of rotation of the motor driven shaft 5 with respect to the motor and wormgear because of the one way clutch bearings 6 and 7. The system illustrated in FIG. 2 includes additional structure which constrains these rotations. The structure that provides this feature also is utilized to generate varying levels of machine resistance.

Figure 2:
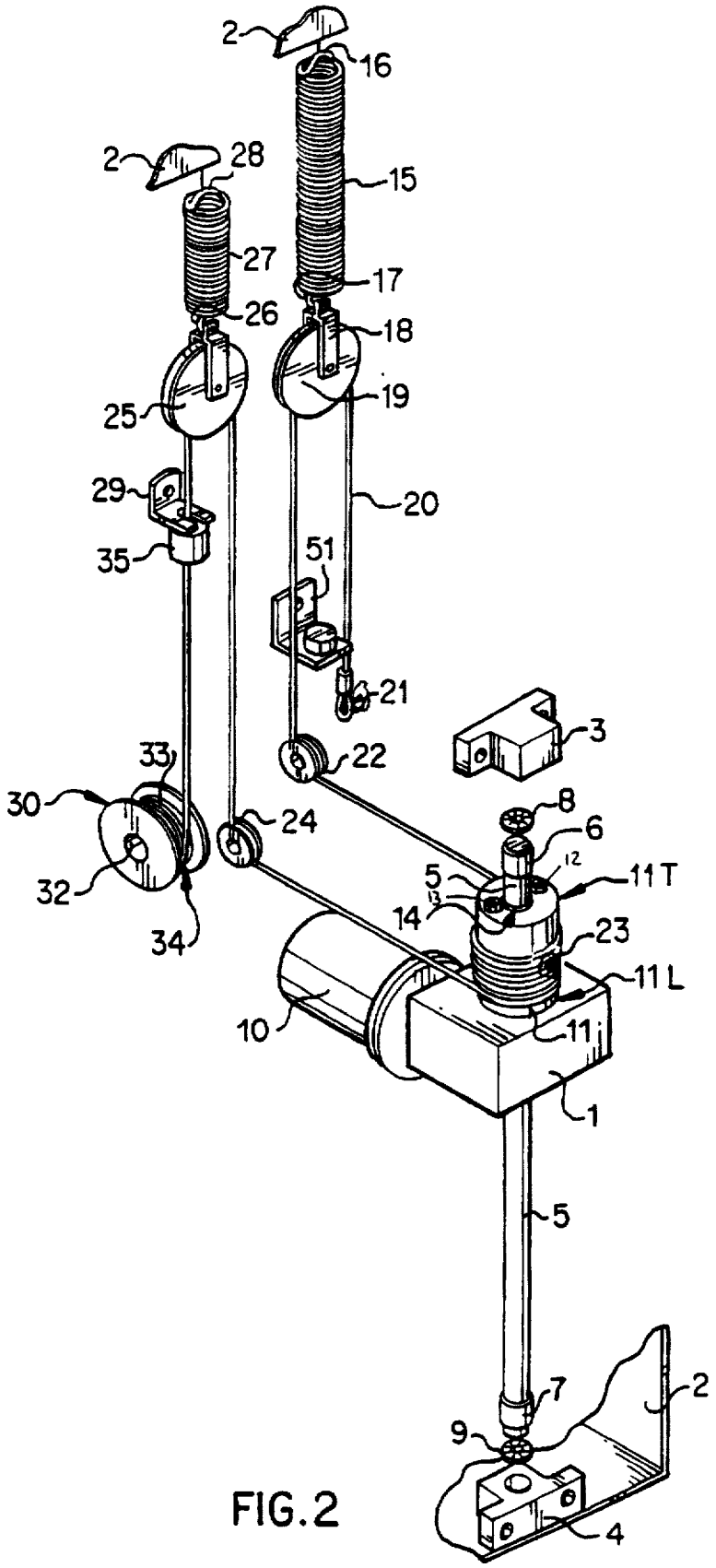
FIG. 2 is a schematic perspective view of a resistive force generating mechanism in which the electrically driven mechanical drive mechanism is in a stable neutral position.

In FIG. 2, a force drum 11 with a midpoint cable anchoring bolt 23 threaded into the drum is fixedly attached by bolts 12 and 13 to the body of the wormgear housing 1. The force drum 11 may be viewed as a type of pulley that is useful in accumulating and dispensing a length of cable. The surface of the force drum 11 may be provided with grooves to accommodate the cable in a secure fashion with minimal risk of cable entanglement. The force drum 11 is equipped with conventional needle bearings 14 pressed into its hub that do not hinder the wormgear output shaft 5 from freely rotating in either direction within the force drum.

A force spring 15 is attached at one end 16 to the apparatus frame 2 and at an opposite end 17 to a floating pulley bracket 18, which carries a force spring pulley 19. In the illustrated embodiment, the force spring 15 has a spring constant of 15 pounds per inch. Although shown as a single tension coil spring, a compression spring, a rotational spring, a compound spring or other suitable force generating element can be used. For example, either an air or hydraulic cylinder in conjunction with an accumulator chamber could be used. However, the use of a spring is preferred as springs are an inexpensive means of generating force. The force spring 15 both serves as the force generating element within the system and, as shall be explained below, helps contain the wormgear housing's clockwise rotation.

A first end of a force cable 20 is fixed to the apparatus frame 2 at an anchor point 21. The force cable 20 is reeved through the force spring pulley 19, and passes under a re-direct pulley 22 that is fixed to the apparatus frame 2. (The particular arrangement of pulleys is in some measure a function of the geometrical constraints imposed by the shape of the housing employed and the mechanical advantage sought, and may be varied accordingly.) The cable is then advanced to the force drum 11, where it is wrapped about the middle half of the force drum 11, leaving the inner and outer one-quarters of the force drum free to accept additional length of force cable 20. The force cable 20 is anchored to the force drum 11 via the threaded midpoint cable anchoring bolt 23 at the midpoint of the force drum to prevent slippage of the force cable 20 with respect to the force drum 11.

The force cable 20 advances under a re-directional pulley 24, which is fixed with respect to the apparatus frame 2. The force cable 20 is then reeved through a counter rotation pulley 25 that is attached to the end 26 of a counter rotation spring 27 that is fixed at its opposite end 28 to the apparatus frame 2. In the illustrated embodiment; the spring constant of the counter rotation spring 27 is 50 pounds/inch. The force cable 20 is then advanced through a bumper stop 29, which is fixed with respect to the apparatus frame 2, and thence terminates at a cable rewind device 30.

The cable rewind device 30 may be of conventional design. In this embodiment, it contains a spiral spring 31 connecting an arbor 32 that is fixed to the apparatus frame 2, and a drum portion 33. The terminating portion of the force cable 20 is wound on the drum 33 so that withdrawal of force cable rotates the drum counterclockwise while increasing the tension exerted by the spiral spring on the force cable 20. The spring-actuated clockwise rotation of the drum 33 rewinds cable onto the drum and occurs whenever the tension exerted by the spiral spring exceeds the force pulling on the force cable 20 in the opposite direction. Prior to anchoring the force cable end 34 to the drum 33, the spiral spring is pretensioned to a 15 pound load with at least one wrap or turn of force cable 20 pre-wound onto the drum 33.

The force spring 15 and the counter rotation spring 27 are preloaded. This is accomplished by displacing the force cable at end 34 a suitable distance. As the cable is pulled towards the cable rewind device 30, the shortening of the available cable length between its anchor point 21 and the rewind device 30 causes both the force spring 15 and the counter rotation spring 27 to extend, which thereby increases their tension. To maintain the springs 15 and 27 at the desired level of pretension, a rubber bumper 35 is fixed to the force cable just below a bumper stop 29, which thereby prevents the force cable 20 from returning to its original available cable length. Any slack in the cable beneath the bumper stop is taken up by the rewind device 30.

Rotation of the wormgear housing 1 is now contained by the two extension springs 15 and 27. The drive motor 10 can now rotate the wormgear input shaft in a direction that will cause the output shaft 5 to turn in a clockwise direction (as viewed from pillow block 3) without simultaneously causing the wormgear housing 1 to rotate about the shaft with respect to the apparatus frame 2. This stable orientation of the motor and wormgear housing is termed the "neutral position."

For a further understanding of the operation of this system, it is useful to consider the dynamic effects of manually rotating the wormgear housing 1 while the wormgear output shaft 5 rotates in the clockwise direction. (Such rotation of the wormgear housing is actually accomplished via user controlled structure set forth below, but is here first discussed as a manual motion to simplify the discussion.)

The rotation of the wormgear housing is opposed by either of the extension springs 15 and 27. If one were manually to rotate the wormgear housing one full revolution in a clockwise direction and then hold it in that position, additional force cable 20 would simultaneously be wrapped onto the force drum 11 along its upper portion 11T. This would concomitantly cause a shortening of the cable between the force drum 11 and the cable anchor point 21, which would in turn cause the force spring 15 to be further extended beyond its pretension, thereby increasing the force provided by the force spring 15 in opposing the clockwise rotation of the wormgear housing and force drum. The extent to which the force spring 15 can be so extended is limited by a stop bumper 51.

Manual rotation of the wormgear housing one full revolution in a clockwise direction will also cause force cable 20 to be unwound from the force drum 11 from its lower portion 11L. This will first cause the counter rotation spring 27 to lose its pretension. As additional cable is unwound from the force drum 11, the rewind device 30 winds the excess cable onto its drum 33, to which is attached the end 34 of the force cable 20. The winding of the force cable 20 onto the drum 33 causes the rubber bumper 35 to move away from the bumper stop 29 towards the rewind device drum 33.

When the wormgear housing is released from this manually rotated position, the tension of the force spring 15 causes the wormgear housing 1 to commence rotation in a counterclockwise direction. The wormgear output shaft 5 is prohibited from counterclockwise rotation with respect to the pillow blocks 3 and 4 by the one way clutch bearings 6 and 7. This serves to constrain the return counterclockwise rotation of the wormgear housing 1 so that it occurs at a controlled rate that does not exceed the speed of the wormgear output shaft 5 with respect to the motor.

As the counterclockwise rotation of the wormgear housing proceeds, force cable 20 is unwound from the rewind drum 33 and wound onto the bottom portion 11L of the force drum 11; force cable 20 is simultaneously unwound from the upper portion 11T of the force drum 11. The cable being removed from the upper portion of the force drum permits the force spring 15 to retract and thereby reduce the force generated therein. As cable is unwound from the rewind drum 33 and wound onto the lower portion of the force drum 11, the rubber bumper 35 moves towards the bumper stop 29.

As soon as the rubber bumper 35 contacts the bumper stop 29, no additional cable is freely available from the rewind device 30 to permit the continued counterclockwise rotation of the wormgear housing 1 and force drum 11. Therefore, any further such counterclockwise rotation will require the extension of the counter rotation spring 27. As the counter rotation spring 27 extends, its increasing tension force slows and finally stops the wormgear housing 1 from further counterclockwise rotation. By using a counter rotation spring having a sufficiently high spring constant (in this embodiment, a spring constant of 50 pounds per inch of extension is used), the neutral position can be quickly and smoothly achieved. The wormgear housing 1 is then again in its neutral position of containment between the opposing tensions of the two extension springs.

3. Machine-User Interface

Figure 3:
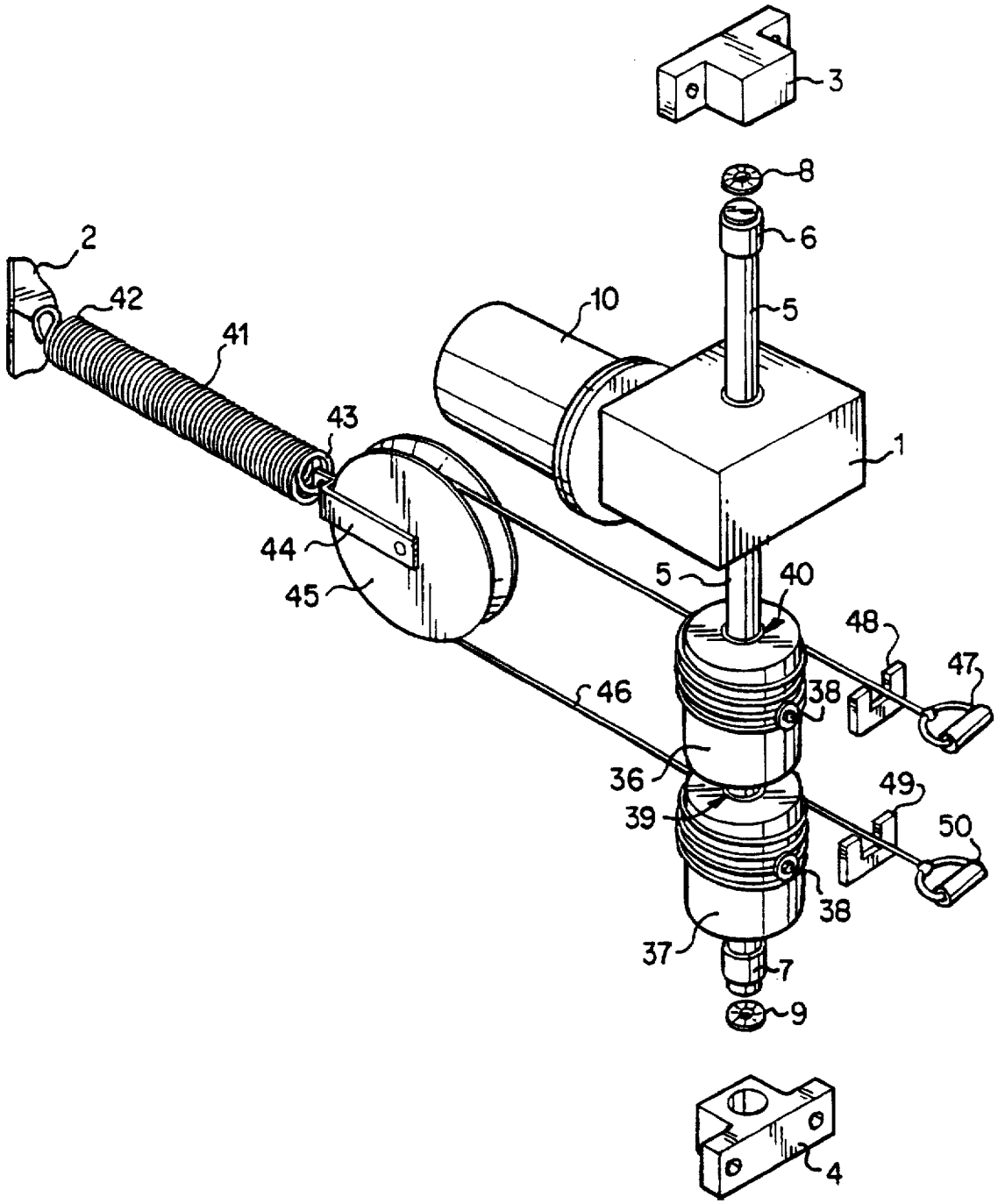
FIG. 3 is a schematic perspective view of the electrically driven mechanical drive mechanism of FIG. 1, but with the addition of speed control drums, operating cables, and a return spring.

FIG. 3 illustrates the apparatus of FIG. 1 with additional structure that provides the user with a mechanical interface with the apparatus. This structure serves to effect the user-directed rotation of the wormgear housing 1 discussed above. Located on the output shaft 5 are two speed control drums 36 and 37, each equipped with a midpoint cable anchoring bolt 38 threaded into the drum. A one-way clutch 39 and 40 disposed within each speed control drum 36 and 37 permits the output shaft 5 to turn clockwise within speed control drums 36 and 37 without providing any driving connection to the drum. The clutch also allows either drum to rotate in a clockwise direction with respect to the pillow blocks at a speed no greater than the clockwise rotation of the output shaft 5.

A return spring 41 which, in the illustrated embodiment has a stiffness of 3 pounds per inch, is attached at end 42 to the apparatus frame 2; at its opposite end 43 it is attached to a floating pulley bracket 44, which carries a return spring pulley 45. A user speed control cable 46 is connected at one end to a right hand user engagement device 47. In the illustrated embodiment; the user engagement device 47 is a handle; however, the engagement device may be any of a number of other devices known in the field of exercise apparatus, such as a lever or crank. By choosing an appropriate engagement device, any muscle group can be exercised.

The cable advances from the right hand user engagement device 47 through a device return stop 48 which is attached to the apparatus frame 2, and thence to the upper portion of the speed control drum 36. As with the force drum 11, the speed control drum is a type of pulley having a grooved outer surface to accommodate a length of cable with minimal risk of entanglement. The user speed control cable 46 is wrapped about the middle half of the speed control drum 36, leaving the inner and outer one-quarter of the grooves on the drum 36 free to accept additional length of user speed control cable 46. The user speed control cable 46 is anchored to the speed control drum 36 via the threaded anchor bolt 38 at the midpoint of the drum to prevent slippage of the cable with respect to the drum. The user speed control cable 46 is then reeved through the return spring pulley 45 and continues to the lower speed control drum 37 that is similar in structure to the upper speed control drum 36. The cable is wrapped about the middle half of the speed control drum 37, leaving the inner and outer one-quarter of the grooves on the speed control drum 37 free to accept additional length of cable. The user speed control cable 46 is anchored to the speed control drum 37 via the threaded anchor bolt 38 at the midpoint of the drum. The cable is then advanced through a device return stop 49, which is fixed with respect to the frame 2, finally terminating at the left hand user engagement device 50.

Visualizing operation of this system can be approached by first considering the geometrical effects attendant to an idealized user motion, commencing from a state in which both handles 47 and 50 are resting against their respective return stops 48 and 49. The user first pulls on handle 47 a distance and then returns the handle 47 to its return stop 48. He then pulls on handle 50 a similar distance before returning it to its stop 49.

During this motion, the user first uses his right hand to pull the user engagement device 47 away from the right device return stop 48 to perform a concentric muscle contraction. (The total distance the user displaces the handle is, of course, in the user's immediate control.) This movement rotates the speed control drum 36 clockwise and causes user speed control cable 46 to be unwrapped from the upper one-half of the speed control drum 36. As this occurs, user speed control cable 46 is simultaneously wrapped onto the lower half of the speed control drum 36. The user speed control cable 46 is unable to pay off from the lower speed control drum 37 because of the geometrical constraint imposed by the left device return stop 49. To recapitulate, when the user begins to pull on user engagement device 47, the only cable available for wrapping onto the lower half of the speed control drum 36 is that which is made available from the cable reeving on either side of the return spring pulley 45 due to the forward motion of the return spring pulley 45 towards speed control drums 36 and 37. This in turn increases the extension of the return spring resulting in greater tension in return spring 41.

At the conclusion of the concentric contraction movement, the user moves the user engagement device 47 towards the device return stop 48. As this occurs, the tension force in the return spring 41 causes the return spring pulley to begin to move away from speed control drums 36 and 37. This causes the speed control drum 36 to turn counterclockwise, which causes slack cable between the user connection device and the speed control drum 36 to be wrapped onto the upper one-half of the speed control drum 36, while simultaneously unwrapping cable from the bottom one-half of drum 36, thereby permitting retraction of the return spring 41 and dissipation of its tension force.

Using his left hand, the user would then commence movement of the left user engagement device 50 away from the device return stop 49 in the performance of a concentric contraction. The same sequence of events, described with respect to speed control drum 36 would now occurs but with respect to speed control drum 37. It should be noted that in actual operation the commencement of the left hand concentric contraction movement would most probably occur prior to conclusion of the right hand's return movement of the right user connection device toward the device return stop. This does not create a problem since the inherent elasticity of the return spring 41 and available travel distance of the return spring pulley 45 will allow either or both user engagement devices 47 and 50 to be moved away from or toward device return stops 48 and 49 independently of one another.

Figure 4:
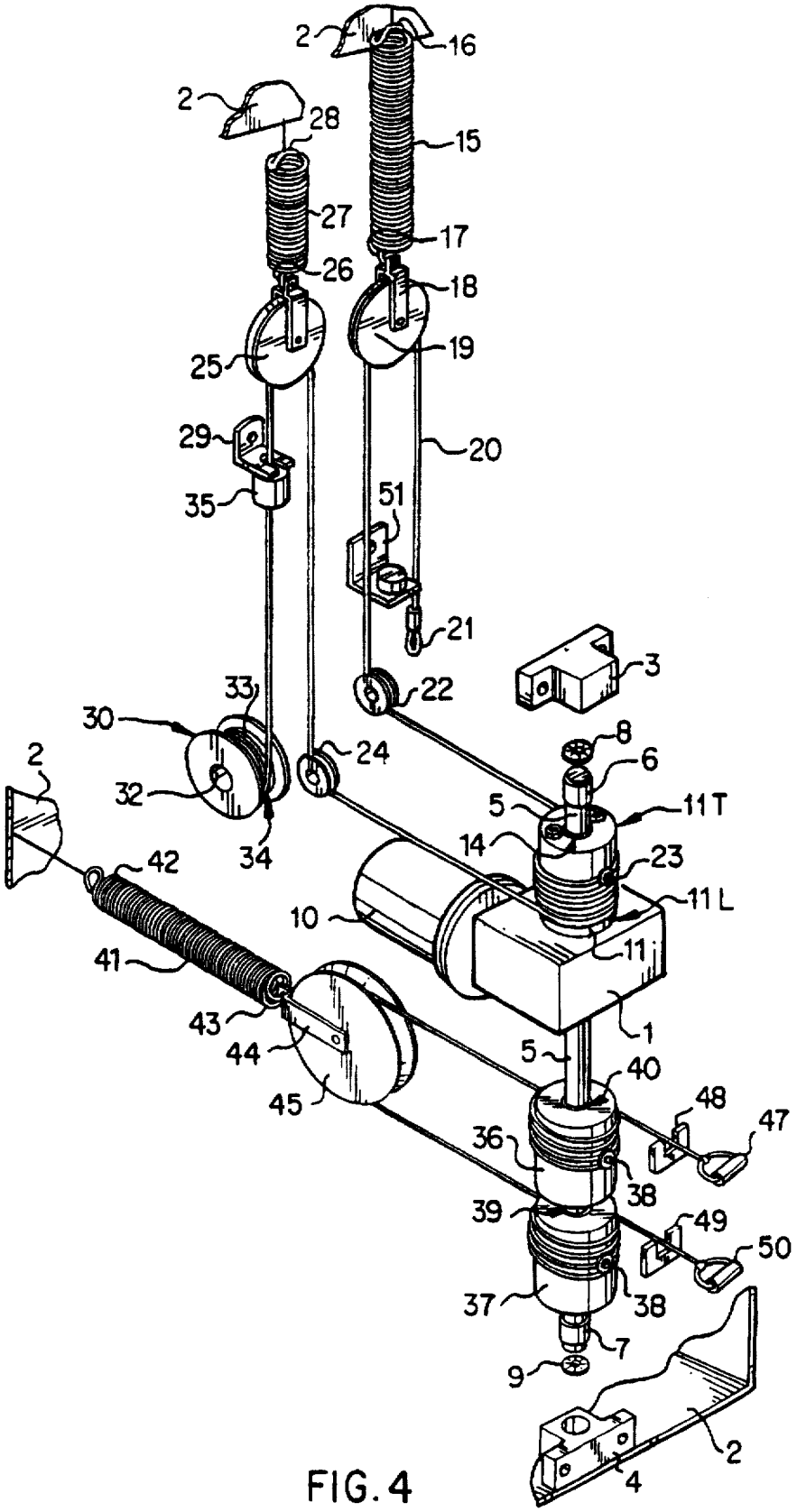
FIG. 4 is a schematic perspective view of the electrically driven mechanical drive mechanism of FIG. 3 with the addition of force generating components.

FIG. 4 shows, in schematic perspective form, all of the elements shown in FIGS. 1–3 placed in proper relationship to one another. The operation of the apparatus shall be explained through the example of a reciprocating concentric contraction motion of the user's left and right arms in pulling on user engagement devices 47 and 50.

Prior to beginning an exercise, the user first selects the speed at which the output shaft 5 turns by interfacing with a controller, which may take the form of a computer. The controller may offer a full range of speeds, or offer a pre-programmed menu of speed profiles to choose from. These profiles may be constant or may vary with time. (In the example which follows, it is assumed that the shaft speed is constant to simplify the discussion.) The controller sets the speed of the wormgear output shaft 5 as desired. As shall be explained below, the greater the speed of the output shaft, the more rapidly the user must move before engaging the variable resistance force generating system highlighted in FIG. 2.

With the wormgear output shaft 5 turning in the clockwise direction (as viewed from above) at the chosen speed, the user commences the workout by pulling the right hand user engagement device 47 away from device return stop 48. Movement of the handle 47 away from the apparatus causes the speed control drum 36 to rotate in the clockwise sense as cable is unwound from the upper half of the drum 36 at an angular speed determined by the diameter of the drum and the speed of the handle 47. So long as the rate of clockwise drum rotation is equal to (the "critically driven" case) or less than (the "under-driven" case) the angular velocity of the wormgear output shaft 5, the only resistance experienced by the user is the increasing force caused by the extension of the return spring 41. However, in the illustrated embodiment, return spring 41 is not very stiff, so that it does not provide much resistance. When, however, the user pulls the user connection device at a velocity which causes the speed control drum 36 to turn at a speed greater than the speed of the wormgear output shaft 5, (i.e., the user attempts to "overdrive" shaft 5), the wormgear housing 1 is forced to rotate in a clockwise direction. This is because the one-way clutch bearings linking the speed control drums to shaft 5 permit only the counterclockwise rotation of the drums with respect to the shaft, and do not permit the clockwise rotation of the drums with respect to the shaft 5.

This clockwise rotation of the speed control drum causes additional force cable 20 to be wrapped onto the force drum 11 at its upper end 11T, since the force drum 11 is fixed with respect to the wormgear housing 1. This causes a shortening of the cable between the force drum 11 and the cable anchor point 21, which causes the force spring 15 to be further extended, thereby increasing the force provided by the force spring 15 in opposing the clockwise rotation caused by the user. This force, applied via the force cable 20 as a torque to the speed control drum 11, is what the user encounters during his workout as machine-supplied resistance.

As the force provided by the force spring 15 increases, so too does the torque transmitted to the speed control drums via the force cable 20, force drum 11, gearing and associated clutching. Again, this torque is applied in opposition to the torque transmitted by the user via the user speed control cable 46 to the speed control drums 36 and 37.

The clockwise rotation of the wormgear housing 1 simultaneously causes the force cable 20 to be unwound from the lower half 11L of force drum 11. Initially, this permits the counter rotation spring 27 to lose its pretension. As additional cable is unwound from the force drum 11, the rewind device 30 winds the excess force cable 20 onto its drum 33. The winding of the force cable onto drum 33 causes the rubber bumper 35 to move away from the bumper stop 29 towards the rewind device drum 33.

As long as the velocity with which the user pulls on the handle causes the speed control drum 36 to turn faster than the wormgear output shaft 5, then the resulting continued clockwise rotation of the force drum 11 will continue to cause the extension of the force spring 15, with a concomitant increase in resistive torque (subject to the geometric constraint imposed by the stop 51). If prior to conclusion of the user's concentric contraction the velocity of the user engagement device 47 is reduced so that the associated unwrapping of user speed control cable 46 from the upper half of the speed control drum 36 causes it to turn at a speed equal to the wormgear output shaft 5 speed, then further extension of the force spring 15 does not occur and the force level of the force spring 15 ceases to change. Thus, the torque level generated by the force spring in opposition to the remaining concentric motion of the user would then remain constant throughout the remainder of the range of motion excursion (the "isotonic" regime).

At the conclusion of the concentric contraction, the user will start to return the user engagement device 47 to the device return stop 48. This is preceded by a drop in the velocity with which the user unwinds user speed control cable 46 from the speed control drum to a velocity beneath the level at which the latter can overdrive the shaft 5. So long as the shaft is underdriven, as it is as the user velocity continues to drop, the tension within the force spring 15 falls as it supplies a torque to the force drum 11 that is no longer countered by a user supplied counter-torque, and the force drum 11 commences to rotate in a counterclockwise direction.

As noted above, the wormgear output shaft 5 is prohibited from counterclockwise rotation by the one way clutch bearings 6 and 7. This limits the rate of counterclockwise rotation of the wormgear housing 1 and force generating drum 11 to a controlled velocity that does not exceed the angular velocity of the wormgear output shaft 5.

During the counterclockwise rotation of the wormgear housing 1, force cable 20 is unwound from the rewind drum 33 and wound onto the bottom half 11L of the force drum 11, while cable is simultaneously unwound from the upper portion 11T of the force generating drum 11. The cable removed from the upper portion of the force drum 11 permits the force spring 15 to retract, thereby reducing its tension level. As force cable 20 is unwound from the rewind drum 33 and wound onto the lower half of the force drum 11, the rubber bumper 35 is displaced towards the bumper stop 29.

As soon as the rubber bumper contacts the bumper stop 29, no more cable will be freely available to accommodate the counterclockwise rotation of the wormgear housing 1 and force drum 11. Any further counterclockwise rotation requires the extension of the counter rotation spring 27. As the extension of the counter rotation spring 27 occurs, its increasing spring tension is transmitted to the force drum as a torque that slows and finally stops the wormgear housing and force drum 11 from further counterclockwise rotation. The force drum 11 then is returned under the torque balance to its neutral position under the influence of the torques provided by the counter rotation spring 27 and the force spring 15.

If the user chooses to commence a concentric contraction of the left arm by pulling the user engagement device 50 away from the return stop 49 at a point in time coinciding with the conclusion of the concentric contraction of the right arm, a somewhat different set of circumstances would occur from those outlined above. If the user's movement of the user engagement device 50 is at a velocity that removes cable from the top of the speed control drum 37 at a rate which causes the speed control drum 37 to turn in a clockwise direction at a speed no greater than the speed of the wormgear output shaft 5 (the critically driven case), then the resistive forces present at the conclusion of the concentric contraction of the right arm would be present at the commencement of the concentric contraction of the left arm and would remain at that constant level for so long as the user's motions continued to drive the shaft 5 at the critically driven speed. If, however, the user pulls on the user engagement device 50 at a velocity which causes the speed control drum 36 to turn at a speed greater than the speed of the wormgear output shaft 5 (the overdriven case), then the wormgear housing 1 will be forced to again rotate additionally in a clockwise direction.

As noted above, such clockwise rotation will cause additional force cable 20 to be wrapped onto the force drum 11 along its upper portion at the top end 11T. This causes a shortening of the cable between the force drum 11 and the cable anchor point 21 which causes the force spring 15 to be further extended, thereby increasing the force provided by the force spring in opposing the clockwise rotation.

As long as the velocity of the user's motion causes the speed control drum 37 to turn faster than the wormgear output shaft 5, then continued clockwise rotation of the wormgear housing will occur with increasing levels of resistance being provided by the increasing extension of the force spring 15. If, prior to conclusion of the user's concentric contraction, the velocity of the user engagement device 50 is reduced so that the unwrapping of cable from the speed control drum 37 causes it to turn at a speed equal to the speed of the wormgear output shaft 5, then further extension of the force spring 15 would not occur and the level of force being applied in opposition to the remaining concentric contraction movement of the user would be constant to the end of the range of motion excursion.

During a concentric contraction movement of either user engagement device 47 or 50, the velocity of the user connection device can be reduced by the user so that the speed control drum 36 or 37 to which the handles are connected via the user speed control cable 46 is allowed to turn at a velocity slightly less than that of the wormgear output shaft 5. Such action permits the wormgear housing 1 to rotate counterclockwise at a speed equal to the speed difference between the clockwise rotating speed control drum 36 or 37 and the wormgear output shaft 5. This results in the controlled reduction in the resistive force being provided by the force spring 15 in opposition to the concentric contraction.

A pulley stop 51 is fixed to the apparatus frame 2. This stop limits the maximum amount of travel (and hence the maximum load) that the force spring 15 can develop. If the user extends the force spring 15 to the point where the force pulley 19 contacts the pulley stop 51, then the apparatus becomes an isokinetic device in which only speed control variations are available. The instant that the force pulley 19 ceases to touch the pulley stop 51, the apparatus reverts to its variable resistance mode.

4. Electronic Control System

Figure 5:
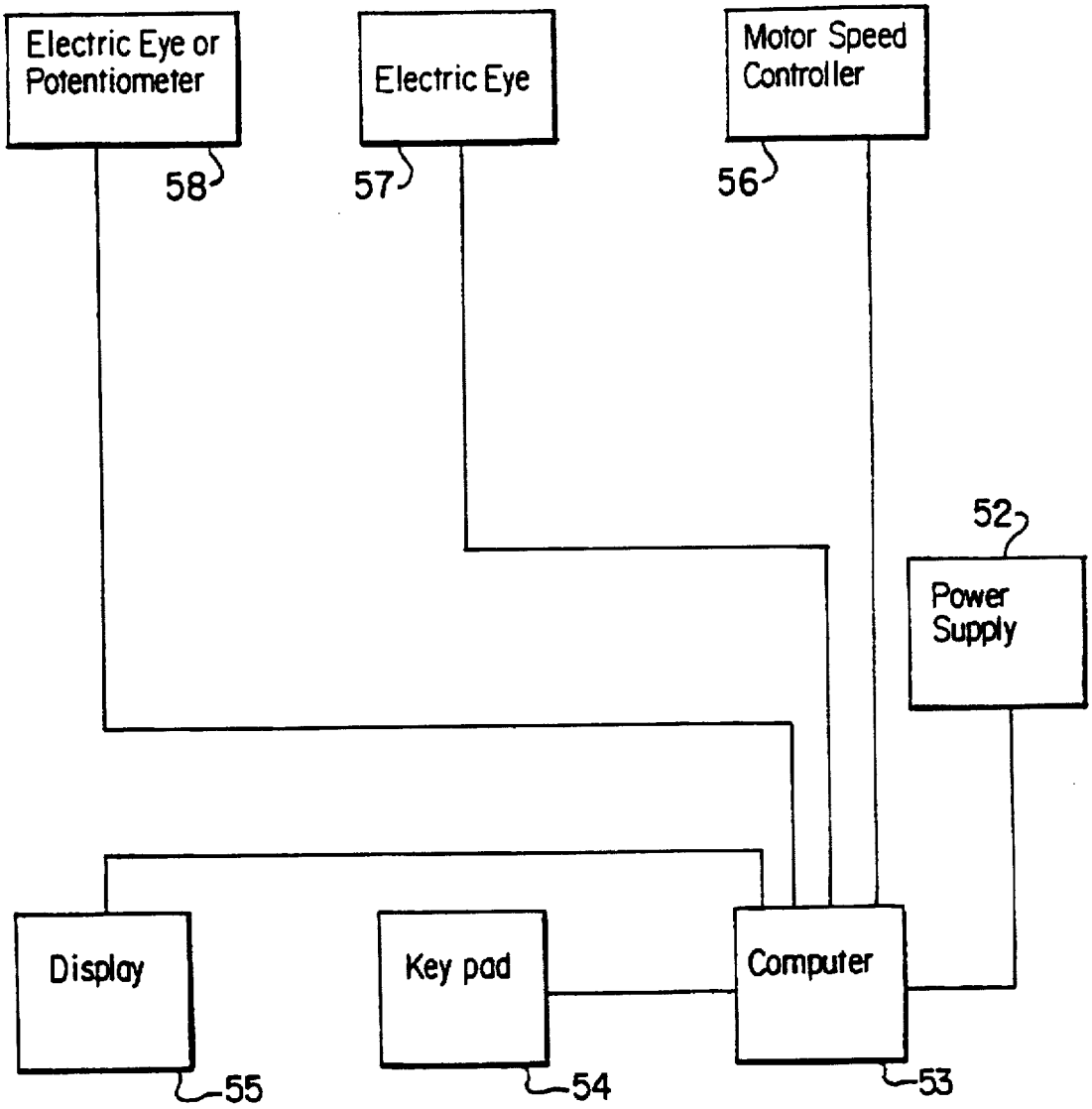
FIG. 5 is a block diagram of the electronics used to control the speed of the electric motor and provide the user with measures of his workout.

FIG. 5 is a block diagram of the individual component parts making up the apparatus electronics. A power supply 52 provides electrical energy to the electrical elements of the system. A computer 53, which may be a microprocessor, is provided with user provided inputs through a keypad 54. These inputs may include speed parameters, timing information pertaining to the desired duration of the workout, maximum or minimum force loads to be sustained, etc. The computer 53 utilizes a display 55 to confirm for the user the selections he has input into the computer, and displays for the user graphical representations of data collected from the apparatus during the workout. These may include user speed, total energy expended, mean user power generated, time, maximum force encountered, number of repetitions performed, force profile data, etc. Conventional sensors of various known types may be employed to measure these variables during operation.

For example, an electronic eye counter 57 may be utilized to provide the computer with data for calculating the speeds being achieved at the wormgear output shaft 5. These actual output shaft speeds are then compared by the computer 53 to the speed data input by the user; appropriate corrections to the drive motor 10 are accomplished by adjustments to the motor speed controller 56. (A closed loop control circuit can be utilized for this purpose.) A second device that can be either an electronic eye or potentiometer 58 provides data to the computer relating to the movement of the wormgear housing 1. This data is used by the computer 53 in making calculations of the resistive forces being provided by the apparatus force spring 15 in opposition to the user's movement. Alternatively, displacement sensors or load cells may be employed at the force spring 15 to measure the load generated by the force spring 15.

A tachometer or other sensor which provides information concerning the speed with which the user executes his repetitions is especially useful. The computer can compare the information so provided to the pre-set shaft speed, and thereby determine whether the user is increasing the resistance generated (as when the user overdrives the shaft), is decreasing the resistance generated (as when the user under drives the shaft), or is in an isotonic mode and maintaining a constant level of resistance (as when the user critically drives the shaft by matching the shaft speed). Suitable indicators, such as LEDs, horns, or other displays may be used to inform the user of his status. (Such indicators are not mandatory, as the user always experiences immediate tactile indication of whether he is underdriving, critically driving, or overdriving the shaft by sensing changes in the machine resistance.)

To recapitulate the operation of the device, the user first sets the speed with which the output shaft 5 rotates. As he commences pulling on the engagement device or devices, he causes the speed control drum or drums to rotate in the same sense as the output shaft 5. For so long as the speed control drums are rotated slower than the shaft 5, the force spring 15 undergoes no further extension. Once the user begins to overdrive the shaft 5 by causing the speed control drum or drums to rotate in the same direction as the shaft but at a rotational speed that is greater than the pre-selected speed of the shaft, he causes the force drum to begin rotating in the same sense as the shaft. This rotation engages a transmission element (here, a cable) that causes the force spring to extend and the force or torque generated by the resistance mechanism to rise. For so long as the shaft is being overdriven, the spring lengthens (up to the limit imposed by the stop 51).

Once a desired resistance level is attained, the user may choose to slow down so that the velocity of the speed control drum matches that of the output shaft 5 with respect to the motor. At this point, the load that the resistance device has developed in response to the overdriving of the shaft 5 is maintained, and the user experiences an isotonic resistance at a pre-set rate of movement. By using a plurality of handles or other engagement devices attached to a plurality of speed control drums, the user may maintain a steady cadence across numerous repetitions at a constant load by using one handle to pick up the slack just as the other one begins to slow down.

The user may alternatively lower the load he encounters by slowing down still further. At this point, with the shaft 5 being underdriven, the force drum 11 can begin to rotate in the opposite sense and then feed cable to the force spring 15 to enable its relaxation. The extent to which the force spring relaxes is determined by the degree to which the shaft 5 is underdriven and the length of time that it is underdriven. The user can halt the fall in load that the apparatus generates as resistance by picking up his pace to again match the shaft 5; he can again increase the load by again overdriving the shaft.

The apparatus thus described provides the user with a wide variety of loading profiles, as suits the user's needs. He can smoothly ramp the machine-generated load up or down without having to interrupt his workout merely by momentarily altering the rate of his workout for a brief interval of time. The load felt by the user can be varied by over- and under driving the shaft 5 for appropriate intervals of time. As previously noted, among the load profiles that can thereby be provided is an isotonic, constant load profile that is attained when the velocity of the exertions of the user just match the speed that he has previously set for the shaft 5.

The versatility of this invention is further seen in that not only can exercise loads be varied, but so too can the speed at which the user experiences them. The user can raise the velocity with which he must work out before engaging the force spring and a given load level by setting the motor and shaft 5 to turn at a higher speed. The user thus has the option of experiencing low loads either at high "ballistic" workout speeds or at low workout speeds, and at all speeds in between. Similarly, he has the option of experiencing high loads at either high or low workout speeds, and at all combinations of workout speed and loading (machine resistance) in between. This versatility enables the apparatus to assist users of widely varying ability with both their strength and cardiovascular fitness goals.

The versatility of the apparatus in providing an inexpensive means of separating the exercise parameters of workout speed and resistance level can be further appreciated by considering its dynamics from a mathematical point of view.

In this example, it is assumed that the force spring 15 has a spring constant of $K_{FS}$. It is further assumed that the force drum 11 and the speed control drums 36 and 37 have an identical outer diameter $r_d$, that the angular velocity of the shaft 5 is $\omega(t)$, and that the user moves the handles with a linear velocity of $v_u(t)$. For a shaft velocity of $\omega(t)$ and with the drums turning with the shaft, cable is wound and unwound from the drums at a rate of $r_d\omega(t)$. Taking both the user velocity and the shaft speed into account, the actual linear speed with which cable is payed off from or accumulated onto the force control drum 11 is identical to the speed with which the force spring 15 lengthens as a function of time:

$$v_{spring\ extension}(t)=v_u(t)-r_d\omega(t)$$

The constitutive equation of a linear spring is $F=K\Delta x$, where $\Delta x$=spring displacement. Therefore, ignoring any pre-load, the force generated by the force spring 15 will be:

$$F = K_{FS}\int_0^t v_u(t) - r_d\omega(t)dt$$

This equation is subject to the condition that the force generating element 15 is not engaged until such time as the user first begins to overdrive the shaft, i.e., $v_u(t)>r_d\omega(t)$.

Now, if $\omega(t)$ is a constant, then we can call $r_d\omega(t)=v_{shaft}$ and the equation takes the form:

$$F = K_{FS}\int_0^t (v_u(t) - v_{shaft})dt$$

One immediately sees that if $v_u(t)=v_{shaft}$, then the force level remains unchanged. If the shaft is overdriven and $v_u(t)$ is a constant (just one of many possibilities), then the force level will rise linearly as a function of time, i.e., $$\Delta force=K_{FS}(v_u-v_{shaft})\ \Delta t.$$

Figure 7:
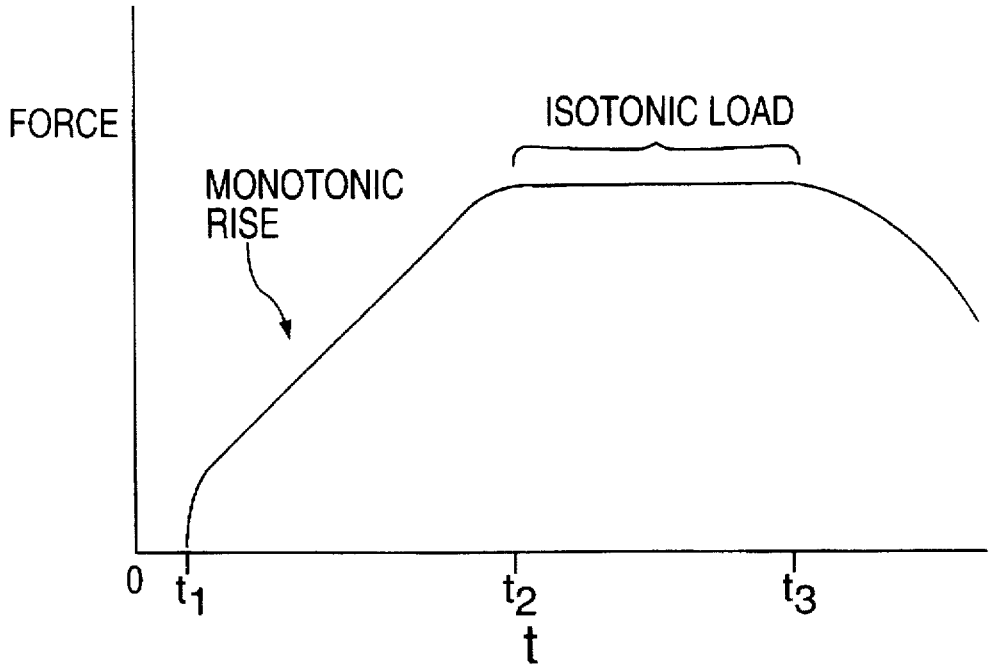
FIG. 7 is a graph showing machine resistance as a function of time for the regime shown in FIG. 7
Figure 6:
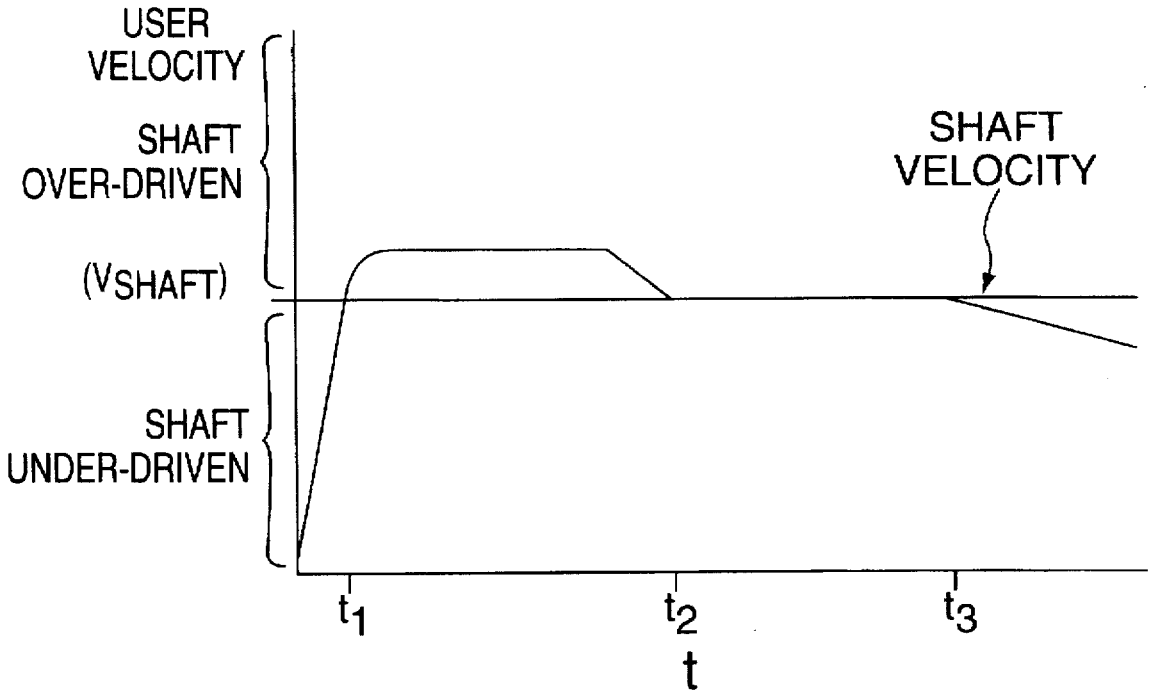
FIG. 6 is a graph of user velocity as a function of time for an exemplary simplified exercise regime.

This case is graphically illustrated in FIGS. 6 and 7. FIG. 6 plots the user velocity $v_u(t)$ as a function of time. From t=0 to $t=t_1$, the user first linearly ramps his velocity up, encountering no machine resistance (ignoring any resistance generated by the return spring 41) until $v_u(t)=v_{shaft}$. As he overdrives the shaft from $t_1$ to $t_2$, the force developed within the force spring 15 rises monotonically. From $t_2$ to $t_3$, the user just matches the shaft speed, resulting in an isotonic form of resistance during this time interval. After $t_3$, the user underdrives the shaft, and the level of resistance provided by the machine via the force spring falls monotonically.

The equations set forth above suggest that to attain a given force level; one may either increase the magnitude of the term $(v_u-v_{shaft})$ (which can be done either by altering the user velocity or the shaft velocity), or one may alter the time $\Delta t$ that the shaft is over- or underdriven. Similarly, for a given level of $v_{shaft}$, any force level can be attained by suitable choice of $v_u$ and $\Delta t$, variables which are under immediate user control throughout the exercise.

Thus, a given force level, be it high or low or intermediate, can be attained at speeds ranging from high to low, depending on $v_{shaft}$ and $\Delta t$. Similarly, for any level of $v_{shaft}$, any force level can be reached by suitable choice of $\Delta t$ and $v_{user}$ (subject only to the physical limitations of the spring). Thus, the user is provided with a wide array of exercise options under his direct and immediate control.

Various modifications to the above-described apparatus can be made. For example, by increasing the number of operating cables and drums and providing additional return-spring structured more than two muscle groups can be accommodated. Indeed, it is possible to modify this apparatus so that concentric contraction resistance could be made available for the extension and flexion of virtually any combination of muscle groups. Alternatively, in an additional embodiment, one of the speed control drums could be dispensed with to provide a device for exercising only one muscle group at a time.

In the above described embodiment, the load that the user works against is provided almost entirely by the force spring 15. The return spring 41 makes little contribution to the load since it is selected to be much less stiff than the force spring. However, in an additional embodiment, the return spring can be selected so as to be much stiffer. This would provide an additional load for the user to overcome in his workout in addition to that provided by the force spring 15.

Another modification which could be made to the apparatus would entail replacing the generally cylindrical drums about which the cables are wound with drums having non-cylindrical contours (e.g., a conic) so as to further modify the operational characteristics of the device. The cables themselves, which are generally made of wire, could be replaced by other force transferring means, such as chains, gearing, or other suitable transmission elements.

Some users may, because of disease, injury, or the effects of aging, be unable to maintain a steady cadence in their workout. This may have the result that the user will experience a very uneven, and possibly harmfully varying level of machine resistance during his workout. By providing an adaptive level of control over the motor speed as a function of the user speed, the shaft speed can be controlled to generally match the speed of the user so as to provide a desired level of loading. The motor may be selectively turned off for brief intervals of time, sped up, or slowed down as needed to match the desired resistance pattern.

More generally, instead of relying on a preset shaft speed profile, the shaft speed can be interactively controlled to vary in dependence upon any combination of the exercise parameters programmed into the controller or picked up by sensors, as may be desired.

This invention affords the user tremendous range in the type of workout that the apparatus can provide, while also providing the user with immediate, interactive control over all of the workout variables, including the mechanical displacement attendant to each exercise excursion, the speed with which this displacement (i.e., the workout) is executed, and the force profiles encountered in the workout. Moreover, since mechanical work is defined to be the product of force and displacement, and since mechanical power is defined to be the product of force and velocity, the invention permits the control over work and power as well. It Is appreciated that in providing such control over all of the key variables that are encountered in the course of its use, the instant invention may find applicability in the fields of strength training, cardiovascular fitness, as well as physical rehabilitation.

A simplified embodiment of an exercise apparatus employing certain principles of the invention is schematically illustrated in FIG. 8. In this embodiment, return spring 141 is connected at one end 142 to the frame of the apparatus; its second end 143 is connected to a pulley bracket 144 holding a return pulley 145, which has teeth. A speed control belt 146, which may be provided with teeth, is reeved about the return pulley 145. Speed control is provided by a combination motor and worm drive 101 which turns a shaft 105 in a predetermined clockwise direction (in a manner very similar to that by which shaft 5 is rotated in the previous embodiment). Also attached to shaft 105 are speed control gears 136 and 137. The speed control gears are attached to the shaft by a clutch which permits only the counterclockwise rotation of gear 137 and the clockwise rotation of gear 136 (as viewed from the opposite side) with respect to the shaft 105. In other words, the shaft 105 is free to rotate in the clockwise direction with respect to the gear 137, but is incapable of counterclockwise rotation with respect to gear 137 (and similarly is incapable of clockwise rotation with respect to gear 136).

The speed control belt 146 extends over the teeth of the speed control gears 136 and 137, terminating at handles 147 and 150. Located about the mid-portion of the motor-wormdrive 101 is a force pulley 111 which is connected via a force cable 120 to a force spring 115 at end 117. End 116 of the force spring 115 is connected to the housing of the apparatus. The shaft 105 is connected by journal bearings to the housing.

At the start of a workout, the user first selects a speed at which shaft 105 is to rotate. The user then pulls on handles 147 and 150 at a velocity that causes the speed control gears 136 and 137 to rotate in a sense that is less than the velocity of the shaft 105. As this occurs, the return pulley 145 advances some to accommodate the retraction of the handles and concomitant retraction of the speed control belts, thereby extending return spring 141. (While it is preferred that return spring 141 be relatively lightweight, i.e., have a low spring constant, the device can be configured so as to provide a stiffer return spring 141 so that this initial aspect of the exercise is more demanding.)

As the user speeds up his pace, he will eventually reach a point at which he begins to overdrive shaft 105. At this point the motor and worm and the force and the force pulley 111 begin to rotate in the clockwise direction and wind force cable 120 onto the force pulley, thereby extending the force spring 115. This will impose a torque upon the force pulley in opposition to the torque supplied by the user. The force or torque will rise so long as the user pulls on the handles at a rate sufficient to cause the shaft 105 to be overdriven. The user will then typically decelerate his workout to the point where he is just matching the rotational angular velocity of the shaft 105, thereby maintaining a generally isotonic workout throughout the rest of his excursion. Upon the termination of an exercise excursion, when the handles are returned towards the handle stops 148 and 149, the speed control gears 136 and 137 cease to overdrive the shaft, and the force spring 115 is then free to retract cable 120 from the force pulley 111.

What is claimed is:

1. An apparatus for generating a resistive force in response to the action of a user, comprising:

a shaft;

a rotatable shaft driver for rotating the shaft at a selected speed in a first rotational sense with respect to the shaft driver;

a first drum connected to the shaft driver for rotation therewith;

a force generator;

a linkage which connects the first drum to the force generator so that rotation of the first drum causes a change in the level of force generated by the force generator and wherein said change in force is transmitted via said linkage to the first drum;

at least a second drum rotatably connected to the shaft via a connection which permits the shaft to rotate in the first directional sense with respect to the second drum but which does not permit the second drum to rotate in that sense with respect to the shaft; and a first cable having a first end and a second end, a length of said cable intermediate the first and second ends being wound onto the second drum so that by extracting cable from the second drum, the second drum can be made to rotate, whereby movement of the first cable at a sufficiently high speed causes the second drum about which it is partially wound to rotate faster than the selected speed of rotation of the shaft driver, which causes the first drum to rotate and thereby engage the force generator.

2. The apparatus of claim 1 wherein the force generator is a spring.

3. The apparatus of claim 2 wherein the linkage which connects the first drum to the force generator translates a rotation of the first drum into a displacement at the force generating spring.

4. The apparatus of claim 3, wherein the linkage which connects the first drum to the spring is a second cable; and wherein the second cable is partially wound along its length about the first drum.

5. The apparatus of claim 4, wherein the first drum has a grooved outer surface for securely accommodating the second cable.

6. The apparatus of claim 4, wherein the first drum includes means for preventing slippage of the cable with respect to the drum.

7. The apparatus of claim 4, further comprising:

a pulley connected to the first spring and about which the second cable is reeved;

a second spring, said second spring being connected to a pulley; and a cable rewind device, wherein the second cable is affixed at one end with respect to a housing for the apparatus, and is then reeved about the pulley of the first spring to the first drum, about which it is partially wound and from which it continues to a reeving about the pulley of the second spring, terminating at the cable rewind device.

8. The apparatus of claim 7, further comprising a mechanical stop located in cooperation with the first spring to limit the displacement of the first spring.

9. The apparatus of claim 7, further comprising a bumper stop and a bumper located along that portion of the second cable that is in between the second spring and the cable rewind device.

10. The apparatus of claim 1, wherein the first drum is mounted onto the shaft.

11. The apparatus of claim 1, wherein the drums are grooved so as to better secure a length of cable to their respective surfaces.

12. The apparatus of claim 1, wherein the second drum is rotationally mounted onto the shaft via a one-way clutch bearing.

13. The apparatus of claim 1, wherein the first cable terminates at an engagement device for transferring forces to and from a user.

14. The apparatus of claim 13, wherein the engagement device is a handle.

15. The apparatus of claim 13, wherein the engagement device is a lever.

16. The apparatus of claim 1, wherein the shaft is connected to a housing via bearings.

17. The apparatus of claim 16, wherein the shaft is connected to the housing via a clutch mechanism that permits the shaft to rotate in only a single rotational sense with respect to the housing.

18. The apparatus of claim 1, wherein the first cable is made of stranded wire.

19. The apparatus of claim 1, wherein the shaft driver is a motor, and includes a gear drive for linking the motor to the shaft.

20. The apparatus of claim 19, wherein the motor is of the speed variable type.

21. The apparatus of claim 20, further comprising a controller for selectively varying the speed of the motor so as to correspondingly vary the speed of the shaft that it drives via the gear drive.

22. The apparatus of claim 1, further comprising a return spring connected to the housing at its first end and to a return spring pulley at its second end, and wherein the first cable is wound onto the second drum and then wound about the return spring pulley.

23. The apparatus of claim 22, further comprising a third drum mounted to the shaft, and wherein the first cable continues from its reeving with the return spring pulley to the third drum, about which it is partially wound, before terminating at an engagement device.

24. The apparatus of claim 1, wherein the force generator has an initial level greater than zero units of force.

25. The apparatus of claim 1, wherein the force generator is engaged only once the second drum has begun to overdrive the shaft.

26. The apparatus of claim 25, wherein the force developed by the force generator rises towards an upper limit for so long as the second drum overdrives the shaft.

27. The apparatus of claim 26, wherein the force developed by the force generator falls towards its initial level whenever the second drum underdrives the shaft.

28. The apparatus of claim 26, wherein the force developed by the force generator remains at a constant level when the second drum rotates at the same speed as the shaft.

29. An apparatus for generating a resistive force in response to the action of a user, comprising:

a shaft;

a rotatable shaft driver for rotating the shaft at a selected speed in a first rotational sense with respect to the shaft driver;

a first drum connected to the shaft driver for rotation therewith;

a force generator;

a linkage which connects the first drum to the force generator so that rotation of the first drum causes a change in the level of force generated by the force generator and wherein said change in force is transmitted via said linkage to the first drum;

at least a second drum rotatably connected to the shaft via a connection which permits the shaft to rotate in the first directional sense with respect to the second drum but which does not permit the second drum to rotate in that sense with respect to the shaft; and a chain having a first end and a second end, a length of said chain intermediate the first and second ends being wound onto the second drum so that by extracting a length of chain from the second drum, the second drum can be made to rotate, whereby movement of the first chain at a sufficiently high speed causes the second drum about which it is partially wound to rotate faster than the selected speed of rotation of the shaft driver, which causes the first drum to rotate and thereby engage the force generator.

30. An exercise apparatus for supplying a varying level of velocity thresholds to a user at which the user engages the force generator of an exercise apparatus, the apparatus comprises:

a housing;

a shaft rotatably connected to said housing;

a speed-variable motor for driving the shaft in a first sense;

at least one speed control drum mounted onto the shaft via a rotation transmission element that permits the drum to freely rotate about the shaft in the opposite sense as the direction of rotation of the shaft, whilst limiting the drum from rotating with respect to the shaft in reverse sense;

a cable that is at least partially wound onto the speed control drum, said cable having a first end and second end, the first end being connected with an engagement device at which a force can be transmitted through the cable to the speed control drum, wherein the orientation with which the cable is partially wrapped about the drum is such that when a tensile load is placed on the cable towards its first end, the cable will urge the rotation of the drum in the same directional sense as the direction in which the shaft is rotating;

a biasing element foe exerting a force on the cable that torques the speed control drum in the opposite sense from the torque which is exerted by the first end of the cable; and a resistance generator that is actuated only once the shaft speed with respect to the housing exceeds the shaft speed with respect to the motor;

wherein by pulling on the cable with a speed sufficient to impart to the speed control drum an angular velocity with respect to the housing that exceeds the angular velocity of the shaft with respect to the motor the shaft is caused to rotate faster with respect to the housing than the speed at which the shaft is driven with respect to the motor.

31. The apparatus of claim 30, wherein $V_{s-h}$=the speed of the shaft with respect to the housing;

$V_{s-m}$=the speed of the shaft with respect to the motor; and whilst $V_{s-h}$ is greater than $V_{s-m}$, then the resistive force generated by the resistance generator rises.

32. The apparatus of claim 31, wherein when $V_{s-h}$ equals $V_{s-m}$, the resistance generator does not alter its resistive force.

33. The apparatus of claim 30, wherein the longer the period of time during which the speed of the shaft with respect to the housing exceeds the speed of the shaft with respect to the motor, the greater the force developed by the resistance generator.

34. The apparatus of claim 30, wherein the greater the degree to which the speed of the shaft with respect to the housing exceeds the speed of the shaft with respect to the motor, the greater the force developed by the resistance generator in a given interval of time.

35. The apparatus of claim 30, wherein the speed control drum is cylindrical.

36. The apparatus of claim 30, wherein the shaft is connected to the housing via bearings that permit the rotation of the shaft with respect to the housing in only one sense.

37. An exercise apparatus for supplying a varying level of velocity thresholds to a user at which the user engages the force generator of an exercise apparatus, the apparatus comprising:

a housing;

a shaft rotatably connected to said housing;

a speed-variable motor for driving the shaft in a first sense;

first and second speed control drums mounted onto the shaft via rotation transmission element that permits the drums to freely rotate about the shaft in the opposite sense as the direction of rotation of the shaft, whilst limiting the drums from rotating with respect to the shaft in the reverse sense a cable that is at least partially wounded onto the first speed control drum and continuing thence through a reeving at a pulley to the second speed control drum about which is at least partially wound, said cable having a first end and a second end, the first and second ends each being connected with an engagement device at which a force can be transmitted through the cable to a speed control drum, wherein the orientation with which the cable is partially wrapped about the drum is such that when a tensile load is placed on the cable towards its first end, the cable will urge the rotation of the drum in the same directional sense as the direction in which the shaft is rotating; and a spring for exerting a force on the cable that torques the speed control drum in the opposite sense from the torque which is exerted by the first end of the cable, wherein by pulling on the cable with speed sufficient to impart to a speed control drum an angular velocity with respect to the housing that exceeds the angular velocity of the shaft with respect to the motor, the shaft is cause to rotate faster with respect to the housing than the speed at which the shaft is driven with respect to the motor.

38. The apparatus of claim 30, wherein the spring is connected at one end to the housing and at its other end to a pulley about which the cable is reeved.

39. An exercise apparatus for supplying a varying level of force to a user, the apparatus comprising:

a housing;

a shaft;

a force drum circum-mounted about said shaft;

a first spring for acting as a force generator, said first spring being connected to a pulley;

a second spring, said second spring being connected to a pulley;

a cable rewind device;

a user controlled mechanical transmission capable of supplying a torque which can rotate the force drum with respect to the housing;

a cable affixed at one end to a housing for the apparatus, said cable being reeved about the pulley of the first spring to the force drum, about which it is partially wound and from which it continues to a reeving about the pulley of the second spring, terminating at the cable rewind device, wherein said cable connects the force drum to the force generator so that rotation of the drum by the user controlled mechanical transmission causes a change in the level of force generated by the force generator and wherein said force is transmitted via said cable to the drum where it is felt as a torque in opposition to the torque provided by the user controlled mechanical transmission.

40. The apparatus of claim 39, wherein the level of force supplied to the user is a function of the degree to which the first spring is displaced, which is in turn a function of the angular displacement experience by the force control drum.

41. The apparatus of claim 39, wherein the user controlled mechanical transmission includes a shaft driver for imparting a predetermined velocity to the shaft in dependence upon which the user can supply a torque to the force drum.

42. An apparatus for use in an exercise machine, comprising:

I) a speed control system having a shaft connected at its ends via bearings to a apparatus housing, said bearings including at least one one-way clutch bearing located on either end of the shaft to permit the shaft to rotate with respect to the housing in only a first rotational sense;

a speed-variable motor for turning the shaft in the first rotational sense permitted by the one way clutch bearing located at the end of the shaft, said speed variable motor being connected to the shaft by a motor speed reduction unit and including a reduction unit housing, said connections between the shaft, motor speed reduction housing and motor being such that when the shaft is caused to be rotated in the first rotational sense at a rate greater than the rate at which it rotates with respect to the reduction unit housing, the motor speed reduction housing is itself rotated in the first directional sense;

II) a force generating system having a force drum having an outer grooved cylindrical surface, an upper portion and a lower portion, said force drum being rotationally mounted to the shaft, said force drum being fixedly connected at one of its sides to the housing of the motor speed reduction unit;

a first spring having a first end and a second end, the first end being attached to the apparatus housing and the second end being connected via a bracket to a first spring pulley;

a second spring having a first end and a second end, the first end of the second spring being attached to the apparatus housing and the second end being connected via a bracket to a second spring pulley;

a pulley stop located in the direction of extension of the first spring at a distance sufficient to halt the further extension of the first spring beyond the location of the pulley stop;

a cable rewind device; and a force cable having a first end and a second end, the force cable being connected to the apparatus housing at its first end and then reeved about the first spring pulley to the force drum, about which it is partially wrapped, the force cable continuing to a reeving about the second spring pulley to a terminus at the cable rewind device; and III) a system for linking the exertions of a user to the apparatus, said system having first and second grooved speed control drums rotatably mounted to the shaft via one-way clutch bearings that permit the shaft to rotate in its first sense with respect to the speed control drums but which do not permit the speed control drums to rotate in that first sense with respect to the shaft;

a return spring having a first end and a second end, said first end being connected to the apparatus housing and said second end being connected via a bracket to a return spring pulley;

a speed control cable extending from a first user engagement device and continuing to the first speed control drum, about which it is partially wrapped before continuing to the reeving about the return spring pulley and thence to the second speed control drum about which it is partially wrapped before terminating at a second user engagement device, wherein movement of the speed control cable causes the speed control drum to which it is attached to rotate in the first sense with respect to the machine apparatus housing;

wherein by moving either end of the speed control cable at a rate sufficient to cause a speed control drum about which it is partially wound to rotate faster than the speed of the shaft with respect to the motor, the force control drum is made to rotate so as to wind additional length of force control cable from the reeving at the first spring pulley, thereby causing the extension of the first spring and the concomitant rise in force generated by the first spring.

43. The apparatus of claim 42, wherein when the force control drum is rotated by the efforts of the user in the first directional sense, it is at an angular velocity that is equal in magnitude to the difference between the angular velocity of the speed control drum with respect to the apparatus housing, and the shaft with respect to the motor.

44. The apparatus of claim 42, further comprising an electronic user interface for entering information concerning the intended operation of the device and a computer based controller for controlling and monitoring the operation of the device.

45. The apparatus of claim 44, further comprising a sensor for determining the load developed within the force generating system.

46. The apparatus of claim 44, further including a sensor for measuring the rate at which the speed control cable is moving at at least one of its end portions.

47. The apparatus of claim 44, further including a sensor for determining the rate at which the shaft turns.

48. The apparatus of claim 44, further including means for determining the work performed by the user.

49. The apparatus of claim 44, further including means for determining the user power output in the course of his exertions.

50. The apparatus of claim 44, further including a sensor for measuring the user's heart rate for display.

51. The apparatus of claim 44, further comprising: means for adaptively controlling the speed of the speed variable motor so as to match the exertions of the user within a pre-defined range.

52. The apparatus of claim 44, wherein the electronic user interface comprises a graphical display.

53. An exercise apparatus, comprising:

a return spring having a first end and a second end, the first end being attached to an apparatus housing and the second end being connected via a bracket to a return spring pulley;

a shaft that is supported within the housing on bearings, said shaft having a pair of toothed pulleys that are linked to the shaft via one-way clutch bearings;

a variable speed motor for turning the shaft in a given direction at a preselected speed, said motor being connected to a force pulley by a mechanical linkage;

a force cable connecting the force pulley to a first end of a force spring, the second end of which is affixed to the housing; and a speed control belt having a toothed surface, said speed control belt being reeved about the return spring pulley to the toothed pulleys at each of its ends, and terminating in connection devices at each end, wherein the orientation of the one-way clutch bearings is such that by pulling on at least one of the connection devices at a rate sufficient to overdrive the shaft, force cable is wound onto the force pulley, causing the force spring to extend and thereby increase the level of force supplied by the force spring to the user.

* * * * *